United States Patent [19]

Ward

[11] 4,333,255

[45] Jun. 8, 1982

[54] ADVERTISING DISPLAY APPARATUS

[75] Inventor: James C. Ward, Saginaw, Mich.

[73] Assignee: Ward Outdoor Advertising, Saginaw, Mich.

[21] Appl. No.: 182,509

[22] Filed: Aug. 29, 1980

[51] Int. Cl.[3] ..... G09F 11/12

[52] U.S. Cl. ..... 40/524; 40/472

[58] Field of Search ..... 40/472, 564, 152.2, 40/524

[56] References Cited

U.S. PATENT DOCUMENTS

| | | | |
|---|---|---|---|
| 2,923,079 | 2/1960 | Bouchard | 40/472 |
| 3,060,604 | 10/1962 | Hirschhorn | 40/472 |
| 3,216,137 | 11/1965 | Brun | 40/472 |
| 3,229,395 | 1/1966 | Belisle | 40/472 |
| 3,824,721 | 7/1974 | Burns | 40/472 |
| 3,849,918 | 11/1974 | Mazzocco | 40/472 |

*Primary Examiner*—Gene Mancene
*Assistant Examiner*—Wenceslao J. Contreras
*Attorney, Agent, or Firm*—John J. Swartz

[57] ABSTRACT

Advertising display apparatus including an endless carrier mounting a plurality of display panels such that the leading and trailing edge portion of the panels overlap the adjacent trailing and leading edge portions of adjacent leading and trailing panels, respectively, and curvilinear guide mechanism for guiding the leading and trailing edge portions of the panels out of the planes of the panels to maintain the edge portions of the panels in overlapping relation as the panels negotiate a curvilinear path portion.

13 Claims, 11 Drawing Figures

ADVERTISING DISPLAY APPARATUS

BACKGROUND OF THE INVENTION

1. Field of the Invention

This invention relates to advertising display apparatus and more particularly to an illuminated advertising sign including a continuously moving conveyor detachably mounting a plurality of individual, vertically disposed intelligence bearing panels which partially overlap adjacent intelligence bearing panels to provide an advertising message.

2. Description of the Prior Art

Iluminated display signs have been provided heretofore such as that disclosed in the U.S. Pat. No. 3,849,918 issued to Dante V. Mazzocco, Sr., on Nov. 26, 1974. This prior art device mounts a plurality of indicia bearing panels in frames which interrupt the continuity of the message provided by the indicia on adjacent panels.

Another advertising device is disclosed in the U.S. Pat. No. 3,060,604, issued to M. Hirshhorn on Oct. 30, 1962, and includes a conveyor mounting a plurality of indicia bearing panels, however, the adjacent panels are spaced apart and light passes between the adjacent panels to create a glare effect.

Another prior art device is disclosed in U.S. Pat. No. 3,824,721, issued to Robert G. Burns on July 23, 1974, and includes a plurality of panels which are connected together in end-to-end relation with respect to each other by slide fasteners to provide in effect a continuous panel. The slide fasteners add to the manufacturing costs and inhibit the quick and easy removal of a panel.

It is an object of the present invention to provide advertising display apparatus including a conveyor, moving in an endless path, having at least one curvilinear portion and a plurality of indicia bearing panels supported thereon in partially overlapping relation with adjacent panels.

It is another object of the present invention to provide advertising display apparatus including an endless conveyor mounting a plurality of individual advertising display panels which provide an uninterrupted advertising message.

It is yet another object of the present invention to provide advertising display apparatus including a conveyor moving in an endless path having a curvilinear path portion, a plurality of indicia bearing panels mounted thereon, and curvilinear guide mechanism for maintaining the panels in overlapping relation as the panels negotiate the curvilinear path portion.

Still another object of the present invention is to provide advertising display apparatus including a plurality of overlapping panels moving in an endless path and inner and outer translucent plates defining a passage through which the panels pass and illuminating mechanism mounted inwardly of the plates for illuminating the panels.

A further object of the present invention is to provide advertising display apparatus including a plurality of intelligence bearing panels and mechanism for individually mounting the panels on an endless conveyor so that substitute panels may be easily installed.

A still further object of the present invention is to provide advertising display apparatus of the type described which includes an outer translucent plate and an inner translucent plate defining a passage for a plurality of advertising display panels having translucent portions defining intelligence, mechanism disposed internally of the panels for transmitting light through the translucent portions, the inner panel being selected from one of a plurality of different colored panels to selectively change the apparent color of the intelligence.

Yet another object of the present invention is to provide advertising display apparatus of the type described including a conveyor moving in an endless path and apparatus for dependently mounting a plurality of indicia bearing panels thereon and keeper mechanism mounted on the endlessly moving conveyor spanning the overlapping portions of adjacent panels.

Other objects and advantages of the present invention will become apparent to those of ordinary skill in the art as the description thereof proceeds.

SUMMARY OF THE INVENTION

Advertising display apparatus comprising a frame, an endless carrier mounted on the frame for movement in an endless path including at least one curvilinear path portion; mechanism for driving the carrier in the endless path; a plurality of individual display panels; mechanism removably, dependently mounting the display panels on the carrier such that the lateral edge portions of the display panels overlap the adjacent lateral edge portions of adjacent panels; and curvilinear guide mechanism for maintaining the edge portions of the panels in overlapping relation as the panels negotiate the curvilinear path portion.

BRIEF DESCRIPTION OF THE DRAWINGS

The present invention may more readily be understood by reference to the accompanying drawings, in which.

DESCRIPTION OF PREFERRED EMBODIMENT

Figure 4:
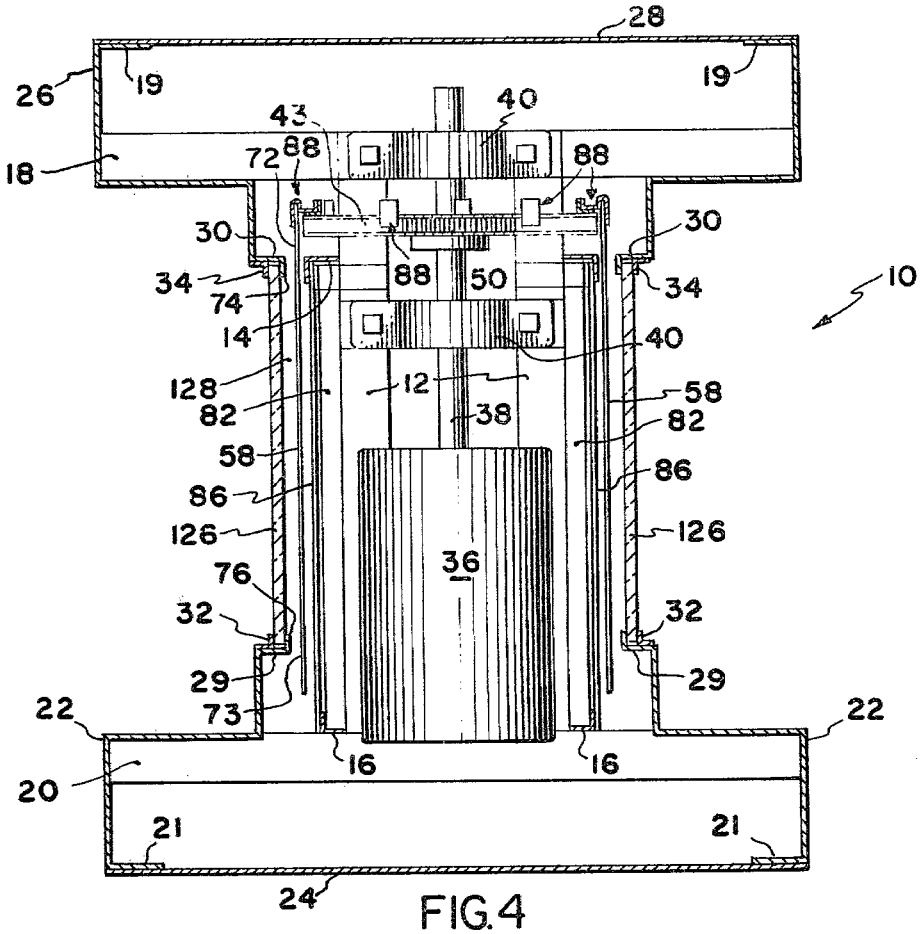
FIG. 4 is an enlarged sectional end view, taken along the line 4—4 of FIG. 3.
Figure 5:
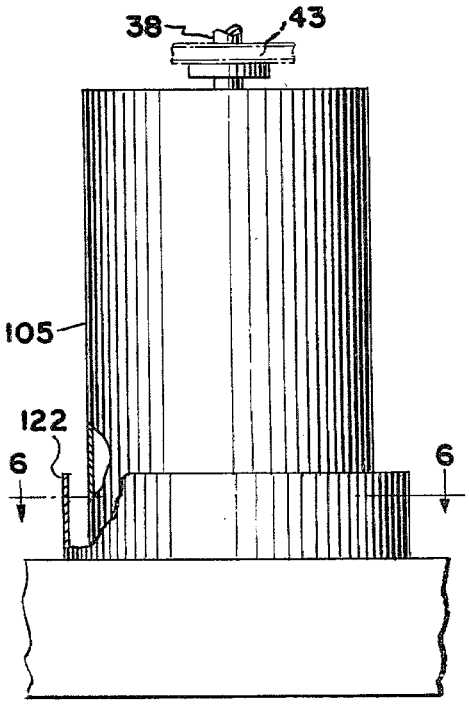
FIG. 5 is a sectional end view illustrating the drive end of the display apparatus, taken along the line 5—5 of FIG. 6.
Figure 6:
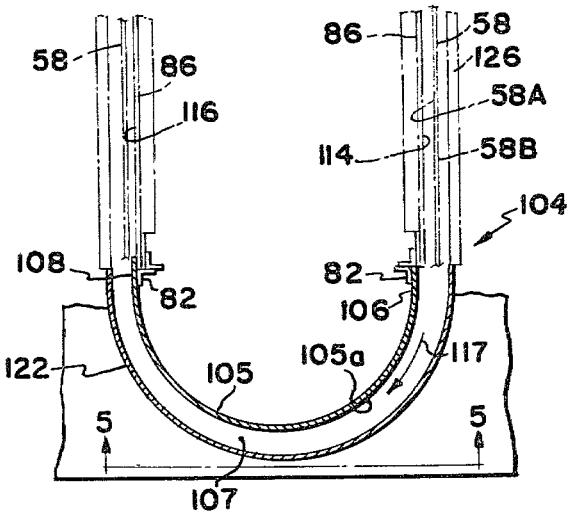
FIG. 6 is a top plan sectional view, taken along the line 6—6 of FIG. 5.

Apparatus constructed according to the present invention, generally designated 10, includes a frame F having vertical end braces 12 spanned by laterally spaced, upper and lower pairs of side rails 14 and 16 respectively. Upper and lower cross-brace members 18 and 20 span the upper and lower side rails 14 and 16 respectively, and project laterally outwardly beyond the vertical braces 12 as illustrated in FIG. 4. Mounted on laterally opposite sides of the lower cross-braces 20 is a pair of generally U-shaped, trim members 22 having lower terminal legs 21 spanned by a bottom wall trim member 24. A pair of generally U-shaped, longitudinally extending, laterally spaced, trim sections 26 are mounted on the upper cross-braces 18 and include upper terminal legs 19 spanned by a longitudinally extending, generally planar top wall trim section 28. End retainer trim panels 25 are mounted on the ends of the upper and lower trim sections 22 and 26 via hinges 27. The trim members 22 and 26 include offset portions 29 and 30, respectively, mounting longitudinally extending vertically spaced, confronting tracks 32 and 34 respectively for a purpose to become more readily apparent hereinafter.

Mounted on one of the lower cross-brace members 20, at one end of the frame F, is an electrically driven, drive motor, generally designated 36, such as a Dayton Gear Motor, part number 3M138. The motor 36 drives an output shaft 38 which is journaled in upper and lower pillow blocks 40 and 42 spanning a pair of the upstanding braces 12. A drive sprocket wheel 43 is fixed to the output shaft 38 interadjacent the pillow blocks 40.

Mounted on the vertical braces 12 at the opposite end of the frame F is a pair of vertically spaced pillow blocks 44 journalling an idler shaft 46 mounting an idler sprocket wheel 48. An endless roller chain 50 is trained around the idler sprocket wheel 48 and the drive sprocket wheel 43. The roller chain 50 includes a plurality of individual links 52 pivotally coupled to adjacent links via coupling plates 55, master link attachments **56*a*, 56*b*, and pivot pins 54. The endless roller chain 50 includes opposed, generally parallel, linear runs 51 and curvilinear end runs 53. As illustrated, the master link attachments are spaced apart along the chain 50. The master links 56*a* include an integral L-shaped panel support member 56. As illustrated, the master link attachments 56*a* and 56*b* are alternately oppositely oriented to balance the chain 50**.

Figure 7:
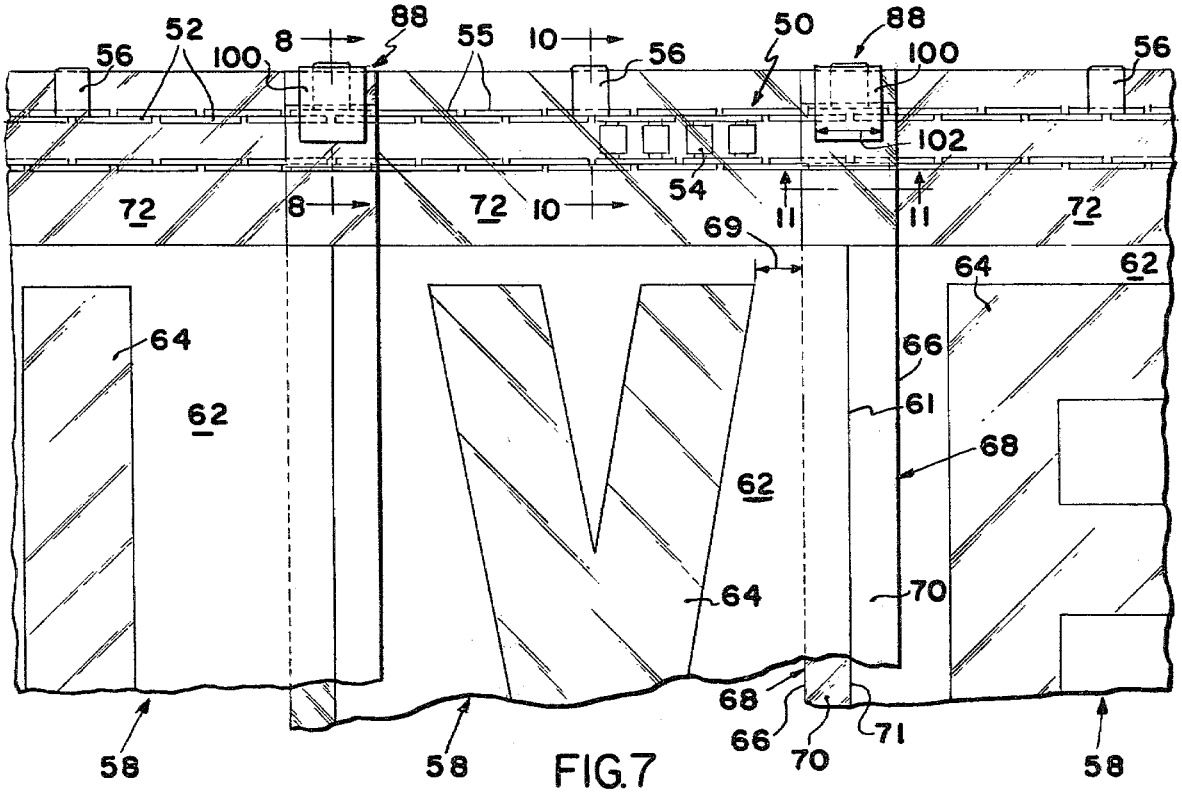
FIG. 7 is an enlarged, side elevational view more particularly illustrating a portion of the display panels mounted on the endless conveyor.
Figure 8:
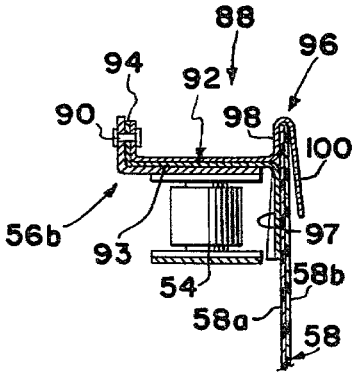
FIG. 8 is an enlarged, sectional end view, taken along the line 8—8 of FIG. 7.
Figure 9:
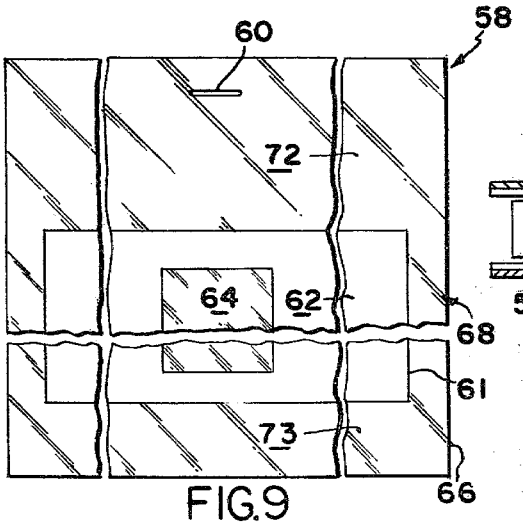
FIG. 9 is a front elevational view illustrating a portion of one advertising display panel only.
Figure 10:
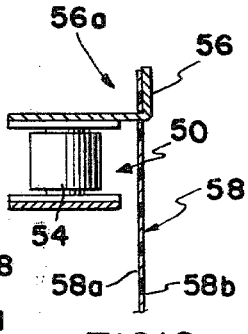
FIG. 10 is an enlarged sectional end view, taken along the line 10—10 of FIG. 7.
Figure 11:
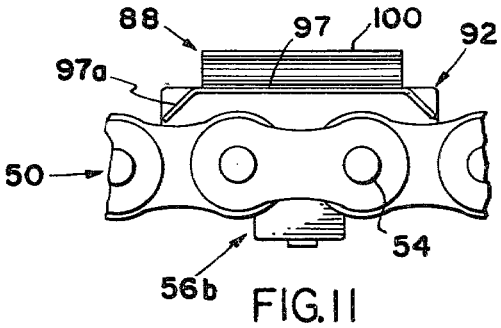
FIG. 11 is a bottom plan view, taken along the line 11—11 of FIG. 7.

A plurality of translucent, yieldable plastic planar panels, generally designated 58, are dependently mounted on the hangar brackets 56 via upper elongate "hangar" slots 60, provided in the panels, which receive the L-shaped mounting bracket 56. The panels 58 include opaque material 62 thereon defining intelligence 64, such as the letter V, as illustrated. The laterally outer edge 61 of opaque material 62 is spaced from the panel edges 66 by a perimetrical translucent border, generally designated 68, including laterally spaced, vertical upstanding translucent border portions 70 and upper and lower translucent border portions 72 and 73. The panel mounting brackets 56 are spaced from adjacent panel mounting brackets 56 such that the lateral edge portions 71 of adjacent panels are overlapping and translucent vertical border portions 70 of each panel overlie the opaque portions 62 laterally inwardly of the translucent border edge portions 70 of the adjacent panels so that light cannot be transmitted between adjacent panels. As illustrated in FIG. 7, the vertical border edges 61 of adjacent panel lie in the same plane. The upper and lower translucent border edge portions 72, 73 are disposed at levels above and below the lower and upper edges 74 and 76, respectively, of the tracks 34 and 32 respectively so that "glare" light does not pass through the top and bottom translucent border portions 72, 73 of the panels 58. As illustrated in FIG. 7, the laterally outermost edge 64A of the translucent intelligence defining panel portion 64 is spaced from the vertical border portions 70 by a distance 69 which is preferably not less than the width of the border portion 70.

Mounted on selected ones of the chain links 52 between the brackets 56, are a plurality of spaced apart panel keeper members generally designated 88, coupled to the master link attachments **56*b* via pop rivets 90. The keeper brackets 88 each include a generally inverted U-shaped keeper portion 96 having an inner vertical flange 98 and a relatively longer, outer vertical flange 100. The width 102 of the keeper members 88 is substantially equal to the width of the adjacent overlapping portions 71 of adjacent panels 58**.

A chain guard, generally designated 92 is sandwiched between the master link attachments **56*b* and the keeper members 88 to ease installation of the translucent panels 58. The guard 92 includes a base 93, an upstanding lip 94 one side thereof and a depending flange 97 extending along the chain link 52. The flange 97 includes turned in end portions 97*a* which serve as guide plates for the panels 58**.

Mounted on the vertical spaced side rails 14 and 16 are vertical end rails 82. A pair of laterally spaced translucent, inner planar glass plates 86 is detachably mounted on the rails 14, 16, and 82. The inner glass plates 86 are selected from any one of a plurality of different colored panels to cause the light passing through the translucent panel portion 64 to assume the color of the selected panel 86.

Figure 1:
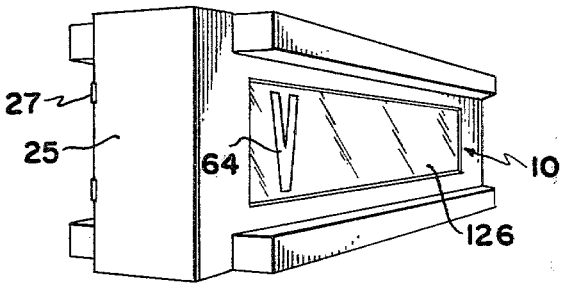
FIG. 1 is a prospective view illustrating advertising display apparatus constructed according to the present invention.
Figure 2:
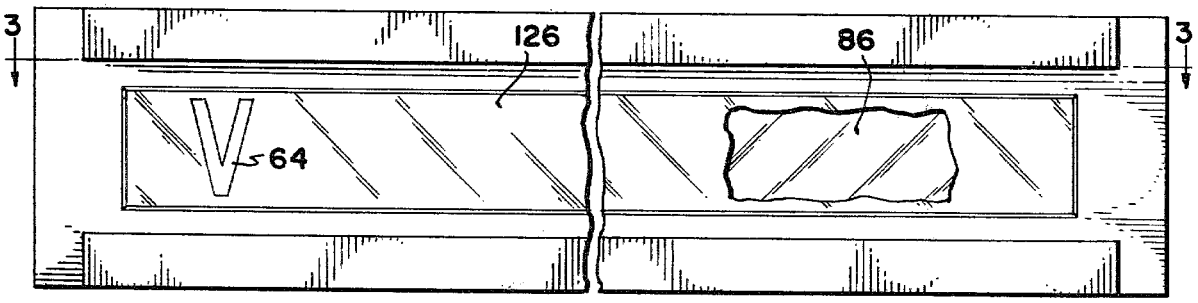
FIG. 2 is an enlarged, front elevational view thereof.
Figure 3:
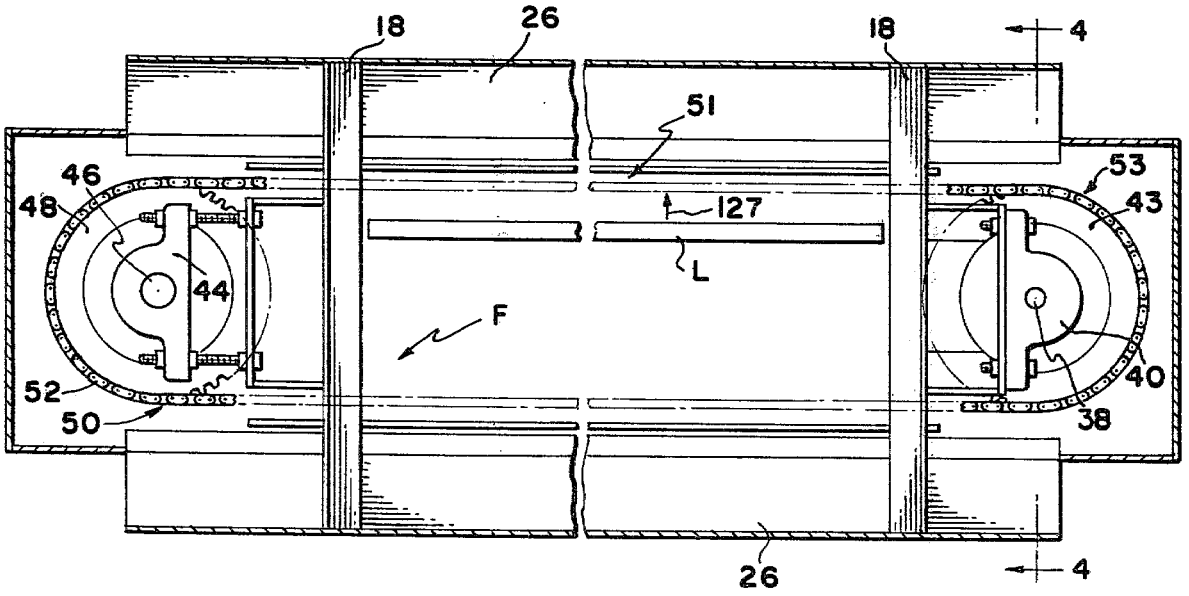
FIG. 3 is a sectional plan view, taken along the line 3—3 of FIG. 2.

An outer, transparent glass or plastic plate 126 is mounted in the tracks 34 and 32 at the front and rear sides of the frame. The inner and outer translucent plates 86 and 126 define longitudinal passages 128 which receive and pass the panels 58 along the linear chain runs 51. Disposed interiorly of the inner glass plate 86 is a florescent lamp, generally designated L (FIG. 3), for outwardly emitting light, in the direction of the arrow 127, to illuminate the advertising display panels 58. The light L will not pass through the opaque panel portions 62 but will pass through the translucent panel portions 64.

Curvilinear guide mechanism, generally designated 104 is provided for maintaining the overlapping panel portions 71 in overlapping engagement with the overlapping portions 71 of the adjacent panels 58 to negotiate the curvilinear end runs. The guide mechanism 104 includes an inner, curvilinear, panel retainer 105 having distal ends 106 and 108 fixed to vertical struts 82 mounted on the vertical braces 12. The vertical height of the inner curvilinear guide plate 105 is at least equal to the vertical height of the display panels. The inner surfaces 58A of the display panels 58 bear against the outer surfaces 105A of the curvilinear guide plates 105 as they negotiate the curvilinear end run portions. It is important to note that the distal end 106 of panel retainer 105 is disposed laterally inwardly of the outer surface 114 of the inner glass panel 86. On the other hand, the distal end 108 of the panel retainer 105 is disposed laterally outwardly of the outer surface 116 of the opposing glass plate 86. The drive motor 36 operates in a direction to move the intelligence bearing panels 58 in the direction of the arrow 117. Because of the relative positions of the panel retainers 105 and glass panels 86, the edges 68 of the panels 58 will not "catch" on the distal end 106 of inner retainer 105 and will not catch on the upstream end 120 of the glass plate 86.

The curvilinear guide mechanism 104 also includes a relatively short, curvilinear outer curvilinear guide plate 122 spaced outwardly of the inner retainer 105 to define a curvilinear guide track 107 for receiving and passing the lower ends of the display panels 58. The outer surface 58B of the panels bear against the inner surface of the curvilinear guides 122 and are thus forced into a curvilinear shape as they negotiate the end run. The inner and outer retainer guides 105 and 122 maintain the overlapping panel portions 71 in overlapping relation.

THE OPERATION

The end trim panels 25 are opened and the motor 36 is intermittently operated to permit the user to install selected individual panels 58 on successive ones of the mounting brackets 56. The panels 58 are selected to provide the selected message. The upper laterally outer edge portions 65 are received by the keeper members 88.

After a full compliment of panels 58 are mounted on the carrier chain 50, the end trim panels 25 are closed and motor 36 is continually operated to continuously move the panels and display the selected message provided by the indicia 64. In the event the message should be changed, the motor 36 is intermittently operated to move the panels to the curvilinear ends. The end trim panels 25 are again opened to provide access to the message bearing panels 58 which are individually removed from the curvilinear guide 104 and from the hook support 56. If desired, the inside planar glass members 86 can be exchanged with a different color glass member to change the color of the letters. The outer glass 126 remains clear so that the legibility of the letter 64 remains clear. In the event that the translucent indicia edge portion 64A extends laterally outwardly closer towards the vertical edge 66 of the panel than that illustrated in FIG. 7, the clear plastic border edge portion 70 of the adjacent panel will permit the indicia 64 to be fully visualized.

It is to be understood that the drawings and descriptive matter are in all cases to be interpreted as merely illustrative of the principles of the invention, rather than as limiting the same in any way, since it is comtemplated that various changes may be made in various elements to achieve like results without departing from the spirit of the invention or the scope of the appended claims.

What I claim is:

1. Advertising display apparatus comprising:

a frame;

an endless carrier mounted on said frame for movement in an endless path including at least one curvilinear path portion;

means for driving said carrier in said endless path;

a plurality of individual display panels;

means removably, dependently mounting said display panels on said carrier such that the leading and trailing edge portions of said display panels overlap the adjacent trailing and leading edge portions of adjacent leading and trailing panels, respectively; and curvilinear guide means for guiding said leading and trailing edge portions of said panels out of the planes of said panels to maintain said edge portions of said panels in overlapping relation as said panels negotiate said curvilinear path portion.

2. The advertising display apparatus set forth in claim 1 wherein inner and outer upstanding spaced apart translucent plates are mounted on said frame defining a passage; said carrier means moving said panels through said passage.

3. The advertising display apparatus set forth in claim 1 wherein said endless carrier is generally oval shaped and includes a pair of opposed, generally parallel, laterally spaced, linear run portions and a pair of opposed, curvilinear, longitudinally spaced run portions; said display apparatus further including first and second pairs of longitudinally extending generally parallel, laterally spaced apart, translucent plates defining longitudinal passages which receive and pass the display panels suspended from said linear run portions; and illuminating means disposed between vertical planes intersecting said linear run portions.

4. The advertising display apparatus set forth in claim 1 wherein said curvilinear guide means comprises an inner curvilinear sheet having a vertical extent at least equal to the vertical extent of said panels against which the inner surfaces of said panels bear and an outer vertical flange spaced from but adjacent the lower end of said curvilinear sheet against which the outer surfaces of said panels bear as the panels negotiate said curvilinear path portions.

5. The advertising display apparatus set forth in claim 4 further including a pair of generally parallel, inner, translucent plates, mounted on said frame, each having a laterally outer generally planar surface, said curvilinear sheet including laterally spaced, distal ends disposed adjacent said translucent panels; one of said distal ends being disposed laterally outwardly of the outer planar surface of the adjacent panel; the other of said adjacent ends being disposed laterally inwardly of the outer planar face of the adjacent panel; said means for driving said carrier being operative to drive said carrier in a direction which will move the panels from said other distal end to said one distal end.

6. The advertising display apparatus set forth in claim 1 wherein said means mounting said display panels on said carrier means comprises a plurality of individual support means coupled to said display panels interjacent said edge portions, and keeper means spanning said overlapping portions of adjacent panels.

7. The apparatus set forth in claim 1 wherein said endless carrier comprises a roller chain having a plurality of links; means coupling adjacent ones of said links together; a plurality of support means, mounted on said links, coupled to portions of said display panels intermediate said edge portions; and a plurality of individual spaced keeper means mounted on said chain, spanning the overlapping edge portions.

8. The apparatus set forth in claim 7 wherein said keeper means comprises a downwardly opening, inverted U-shaped portion which receives the upper ends of said overlapping edge portions of adjacent panels.

9. The apparatus set forth in claim 1 wherein said panels comprise flexible, vertically disposed sheets having opaque portions and translucent portions, said translucent portions including translucent vertical border sections disposed between the lateral edges of said sheets and said opaque portions.

10. The apparatus set forth in claim 9 wherein said panel mounting apparatus mounts said panels such that the translucent vertical border portions of each sheet are disposed in overlapping relation with said opaque portions of the adjacent sheets.

11. The apparatus set forth in claim 1 wherein said endless carrier comprises an endless chain having a pair of opposed, generally parallel linear side run portions and a pair opposed, curvilinear, end run portions joined thereto; said mounting means including a plurality of spaced apart panel support members on said chain for vertically supporting said panels; and further including at least one pair of inner and outer, generally parallel, longitudinally extending translucent plates disposed at a level below one of said side run portions for receiving and passing the panels supported by said linear run portions; said curvilinear guide means including an inner curvilinear guide sheet disposed at a level below each curvilinear end run portion and an outer generally vertical guide flange which has a vertical height substantially less than the vertical height of said curvilinear guide sheet to provide access for removal of said panels from said mounting means.

12. The advertising display apparatus set forth in claim 2 wherein said inner panel comprises a colored panel.

13. The advertising display apparatus set forth in claim 12 wherein each of said panels comprises a translucent panel having opaque material thereon defining centrally positioned indicia and a translucent perimetrical border.

* * * * *